US005526887A

United States Patent [19]

Vestavik

[11] Patent Number: 5,526,887

[45] Date of Patent: Jun. 18, 1996

[54] DEVICE FOR DRILLING HOLES IN THE CRUST OF THE EARTH, ESPECIALLY FOR DRILLING OIL WELLS

[75] Inventor: Ola M. Vestavik, Hafrsfjord, Norway

[73] Assignee: Rogalandsforskning, Norway

[21] Appl. No.: 448,541

[22] PCT Filed: Dec. 13, 1993

[86] PCT No.: PCT/NO93/00190

§ 371 Date: Jun. 15, 1995

§ 102(e) Date: Jun. 15, 1995

[87] PCT Pub. No.: WO94/13925

PCT Pub. Date: Jun. 23, 1994

[30] Foreign Application Priority Data

Dec. 16, 1992 [NO] Norway ..... 924879

[51] Int. Cl.[6] ..... E21B 21/00

[52] U.S. Cl. ..... 175/92; 175/213; 175/215; 175/324

[58] Field of Search ..... 175/324, 213, 175/215, 325.5, 92, 102

[56] References Cited

U.S. PATENT DOCUMENTS

| | | | |
|---|---|---|---|
| 597,316 | 1/1898 | Durbrow | 175/215 |
| 1,585,969 | 5/1926 | Ferguson | 175/70 |
| 2,329,330 | 9/1943 | Brailey | 175/213 |
| 2,684,835 | 7/1954 | Moore | 175/321 |
| 2,716,018 | 8/1955 | Williams | 175/70 |
| 3,638,742 | 2/1972 | Wallace | 175/215 X |
| 4,534,426 | 8/1985 | Hooper | 175/65 |
| 4,630,691 | 12/1986 | Hooper | 175/65 |

FOREIGN PATENT DOCUMENTS

| | | | |
|---|---|---|---|
| 617824 | 9/1933 | Germany | 175/215 |
| 1815725 | 12/1968 | Germany . | |
| 2461352 | 12/1974 | Germany . | |
| 2920049 | 5/1979 | Germany . | |
| 443960 | 6/1975 | U.S.S.R. | 175/215 |

*Primary Examiner*—Hoang C. Dang

*Attorney, Agent, or Firm*—D. Peter Hochberg; Mark Kusner; Michael Jaffe

[57] ABSTRACT

A device for drilling holes (1) in the crust of the earth, especially for drilling oil wells, wherein a rotary bit (2) is fitted in a drill string (4), within which drilling fluid is pumped downwardly and, upon return, conveys cuttings to the surface. A piston (5) is mounted on the drill string (4) above the bit (2) and adapted to form a sliding seal against the wall of the hole (1). A seal (8) is mounted above the piston (5) within the hole (1) and adapted to seal against the wall of the hole (1), against the drill string (4), against a return line (6) adapted to conduct drilling fluid with cuttings from the under side of the piston (5) to the top of the seal (8), as well as against a pipe (9) communicating with a pump (10) adapted to pump liquid in between the seal (8) and the piston (5), whereby liquid pressure acting against the upper face of the piston (5) urges the bit (2) against the bottom of the hole (1).

6 Claims, 3 Drawing Sheets

DEVICE FOR DRILLING HOLES IN THE CRUST OF THE EARTH, ESPECIALLY FOR DRILLING OIL WELLS

The invention relates to a device for drilling holes in the crust of the earth, especially for drilling oil wells.

When drilling for oil, the bit is urged against the bottom of the bore hole by means of drill collars disposed on the drill string above the bit. Drilling fluid is pumped down through the tubular drill string and out through rinsing nozzles of the bit, whereafter the drilling fluid returns into the annulus at the outside of the drill string. The drilling fluid serves two purposes. Firstly, the hydrostatic pressure from the drilling fluid is to prevent reservoir fluid from forcing its way into the hole. The density of the drilling fluid is continuously adjusted in order to maintain hydrostatic pressure balance. Secondly, the drilling fluid is to convey cuttings from the bottom of the hole, upwardly to the surface.

A disadvantage of drill collars in order to give the bit the necessary contact force against the bottom of the hole, is that such drill collars give little effect with drilling in horizontal or approximately horizontal direction. It is known to replace collars with a packer or a piston sealing outwardly against the hole wall, and which is mounted on the drill string just above the bit. The hydrostatic pressure from the drilling fluid within the hole exerts a pressure against the top face of said piston and urges the bit against the bottom of the hole, drilling fluid being pumped from the bottom side of said piston back to the surface by means of a pump of its own or by means of a gas lift. A disadvantage of this known arrangement is that the obtainable contact force acting on the bit is entirely dependent on the density of the drilling fluid. Also, it is a disadvantage that the drilling fluid, which has to convey cuttings to the surface, is the same fluid that has to secure that reservoir fluid does not force its way into the hole; these properties not always being equally combineable.

Also, it is a disadvantage of known drill devices that the density of the drilling fluid has to be monitored and adjusted continuously, in order to maintain the hydrostatic pressure balance within the hole.

The objects of the invention are to provide a device for drilling wherein the bit is urged hydraulically against the bottom of the hole, and wherein drilling fluid returns to the surface without the use of an extra downhole pump or gas lift, and wherein the pressure balance within the hole can be maintained without altering the density of the drilling fluid.

In accordance with the invention, the objects are achieved through the features defined in the following claims.

An embodiment of the invention is described in the following, reference being made to the attached drawings, wherein.

Figure 1:
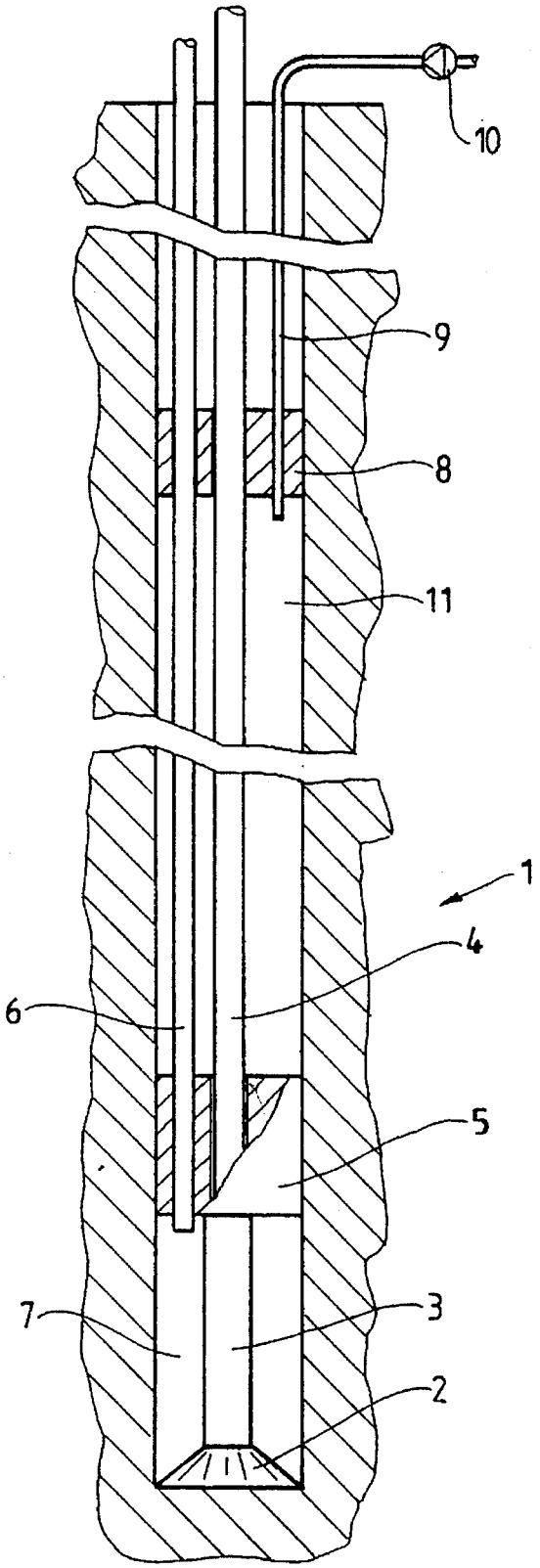
FIG. 1 shows, diagrammatically and partly in section, an oil well with drilling equipment.

In FIG. 1, reference numeral 1 denotes a hole drilled in the crust of the earth. A bit 2 is adapted to be operated from a downhole motor 3 mounted in a drill string 4. Drilling fluid is pumped downwardly through the drill string 4 by means of a pump device (not shown) of known type. Advantageously, the drill string 4 may be of coil pipe type. A piston 5 is disposed on the drill string 4 above the bit 2 and is adapted to slide sealingly against the wall of the hole 1. Advantageously, the piston 5 may be adapted to expand, in order to form the sliding seal against the wall of the hole 1, when the liquid pressure within the drill string exceeds a predetermined value. A return line 6 for drilling fluid is passed through the piston 5 from a volume defined by the bottom and wall of the hole 1 as well as the piston 5. During drilling, the return line 6, which advantageously may be a coil pipe, conducts drilling fluid from the volume 7 to the surface. A seal 8 is disposed within the hole 1, spaced above the piston 5, and is adapted to seal against the wall of the hole 1 and against the drill string 4 and the return line 6. The seal 8 permits that the drill string 4 and the return line 6 may slide into and out of the hole 1. The drill string 4 and the return line 6 may be separate units such as in FIG. 1, but they may also be assembled, e.g. in that the return line 6 surrounds the drill string 4. A pipe 9 communicates with the outlet of a pressure-controlled pump 10 and with a volume 11 defined by the piston 5, the seal 8 and the wall of the hole 1. During drilling, drilling fluid is pumped, in a manner known per se, downwardly through the drill string 4 and further through rinsing nozzles of the bit 2. Drilling fluid carrying cuttings returns to the surface through the return line 6. The pressure within the return line 6 and the volume 7 may be controlled by means of an outlet valve (not shown) disposed within the return line 6, preferably adjacent the surface. The volume 11 is filled with a liquid which is kept under pressure by means of the pump 10. The liquid pressure within the volume 11 exerts a force on the top face of the piston 5, and the piston 5 urges the bit against the bottom of the hole 1. The force acting on the top of the piston 5 is determined by the outlet pressure of the pump 10 together with the hydrostatic pressure which originates in the liquid within the volume 11, whilst the force on the bottom of the piston 5 is determined by the pressure within the volume 7. Possible liquid leaks past the piston 5, from the volume 11 to the volume 7, is drained to the surface through the return line 6. Through controlling the pressure within the volumes 7 and 11, the contact force of the bit 2 against the bottom of the hole 1 can be controlled. By letting the pressure within the volume 7 become larger than the pressure within the volume 11, the piston force may be utilized in order to bring the drill equipment out of the hole 1.

Figure 2:
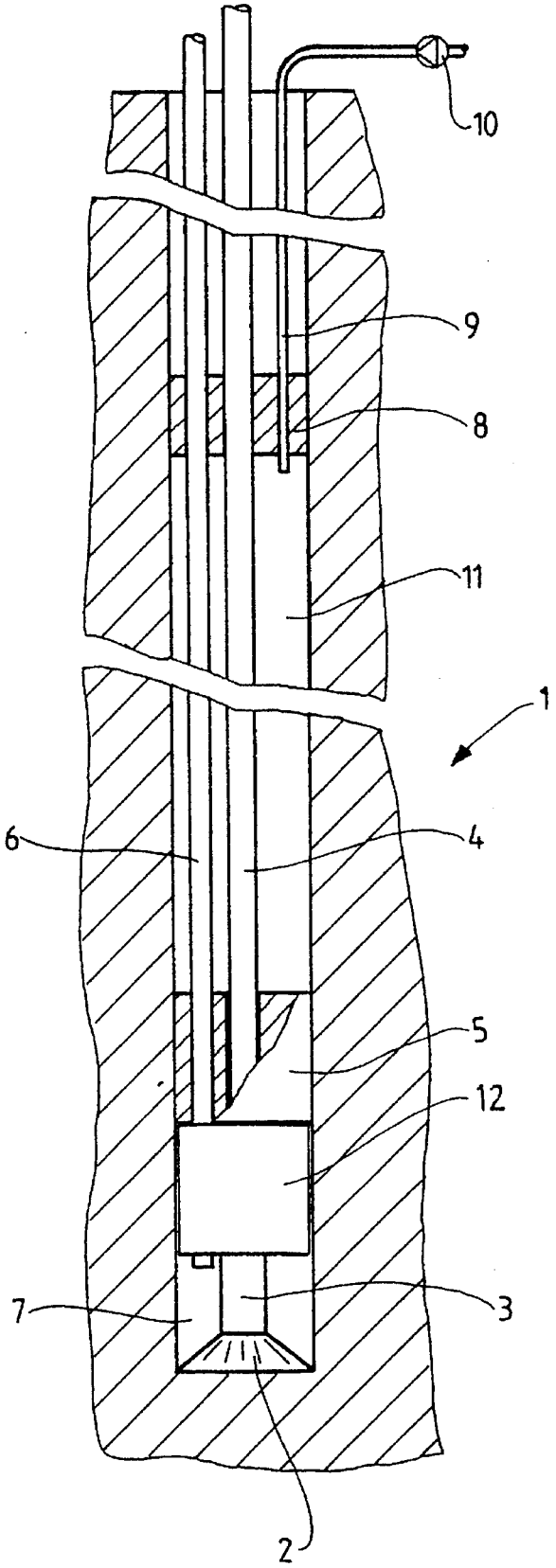
FIG. 2 shows, diagrammatically and partly in section, an oil well with drilling equiment applying a sealing layer to the hole wall.

FIG. 2 shows a corresponding drill equipment as in FIG. 1, but wherein, intermediate the piston 5 and the bit 2, is disposed a unit 12 which is adapted to apply a special pore-sealing material or impregnation on the wall of the hole 1 during drilling. Pore-sealing material may be stored within the unit 12, or may also be supplied from the surface through a pipe connection, not shown. Alternatively, the unit 12 may contain a stocking which is placed against the wall of the hole 1, preferably while the drill equipment is being pulled out from the hole 1. Such a stocking acts sealingly against the formation.

Figure 3:
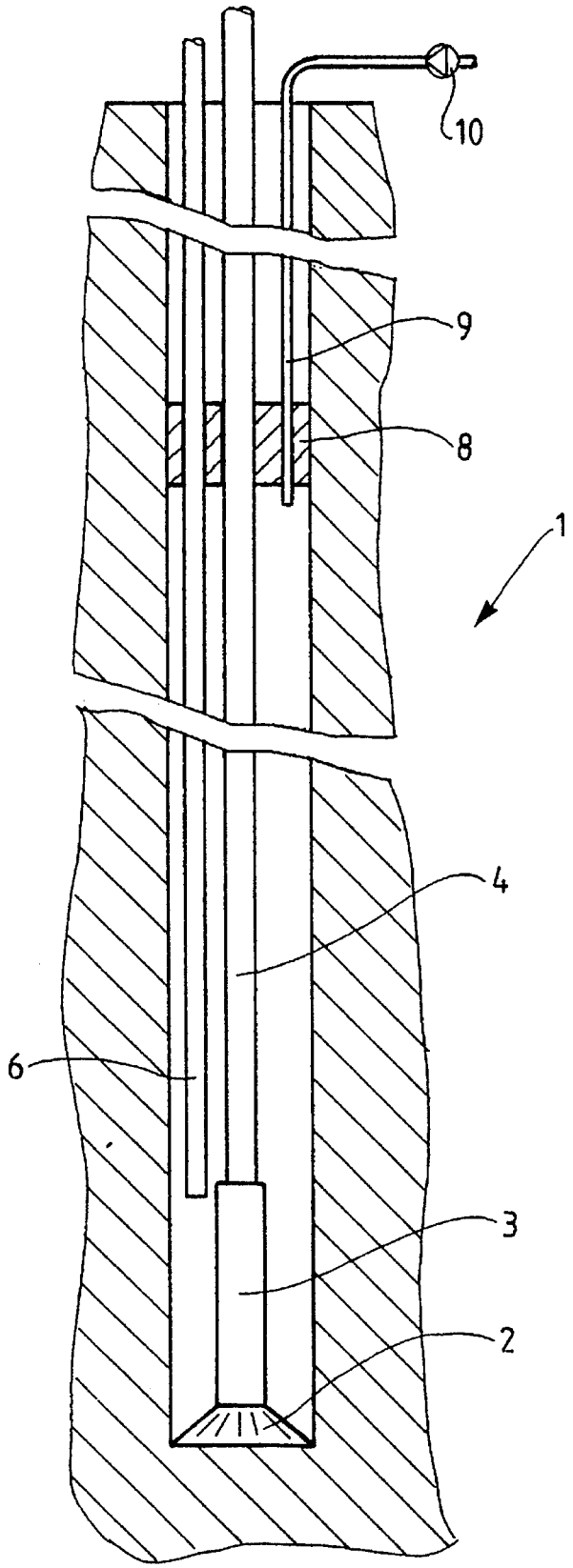
FIG. 3 shows, diagrammatically and partly in section, an oil well with simplified drilling equipment.

FIG. 3 shows a simplified version of the drill equipment, without the use of a piston. Upon drilling, the hole 1 is pressurized from the pump 10 through drilling fluid, such as already explained. Drilling fluid with cuttings return to the surface through the return line 6. The contact force of the bit against the bottom of the hole 1 is provided in a known way, e.g. by means of collars. Fluid from the pump 10 flows in the annulus and returns through the return line 6, that has its lower end in the drill collar region. Pressure drop due to friction in the annulus, especially in the drill collar region, imposes an additional downward force on the drill bit.

I claim:

1. A device for drilling oil wells and other holes in the crust of the earth, said device comprising:

a drill string for conveying drilling fluid in a hole being drilled;

a rotary bit operatively attached to the drill string;

a piston operatively attached to the drill string closer to the entrance of the hole than the rotary bit, said piston forming a sliding seal against the wall of the hole;

a return line extending from between the rotary bit and the piston, to the entrance of the hole, for conveying drilling fluid and cuttings from the hole between the rotary bit and the piston to the entrance of the hole;

a liquid pipe extending from the entrance of the hole to a discharge location above said piston, for conveying liquid under pressure for discharge at said discharge location; and a seal operatively attached to said drill string closer to the entrance of the hole than said discharge location of said liquid pipe, said seal forming a seal with the wall of the hole, said drill string, said return line and said liquid pipe;

wherein the liquid under pressure is discharged from said liquid pipe between said piston and said seal for moving said piston and urging said rotary bit against the end of the hole.

2. A device according to claim 1 and further comprising a coating unit operatively connected to said drill string for coating the wall of the hole with a sealing substance.

3. A device according to claim 2 wherein said sealing substance is a stocking.

4. A device according to claim 2 wherein said sealing substance is a pore-sealing substance.

5. A device according to claim 1 wherein said piston is expandable when the pressure of the drilling fluid in said drill string exceeds a predetermined value.

6. A device for drilling oil wells and other holes in the crust of the earth, said device comprising:

a drill string for conveying drilling fluid in a hole being drilled;

a rotary bit operatively attached to said drill string;

a return line extending from a location near said rotary bit to the entrance of the hole, for conveying drilling fluid and cuttings from the hole near said rotary bit to the entrance of the hole;

a liquid pipe extending from the entrance of the hole to a discharge location above said rotary bit, for conveying liquid under pressure for discharge at said discharge location; and a seal operatively connected to said drill string closer to the entrance of the hole than said discharge location of said liquid pipe, said seal forming a seal with the wall of the hole, said drill string, said return line and said liquid pipe;

wherein liquid under pressure between said seal and the bottom of the hole urges drilling fluid and cuttings through said return line to the surface of the hole.

* * * * *